US007578501B2

(12) United States Patent
Noll, Jr. et al.

(10) Patent No.: US 7,578,501 B2
(45) Date of Patent: Aug. 25, 2009

(54) PRODUCT FEEDER WITH ACCELERATOR AND DECELERATOR DEVICES

(75) Inventors: Harry C. Noll, Jr., Whitehall, PA (US); Randy R. Seidel, Allentown, PA (US); Timothy E. Goszka, Emmaus, PA (US)

(73) Assignee: Muller Martini Mailroom Systems, Inc., Allentown, PA (US)

( * ) Notice: Subject to any disclaimer, the term of this patent is extended or adjusted under 35 U.S.C. 154(b) by 409 days.

(21) Appl. No.: 11/250,721

(22) Filed: Oct. 14, 2005

(65) Prior Publication Data

US 2007/0007722 A1 Jan. 11, 2007

Related U.S. Application Data

(60) Provisional application No. 60/618,811, filed on Oct. 14, 2004.

(51) Int. Cl.
*B65H 29/68* (2006.01)

(52) U.S. Cl. ..... 271/182; 271/273

(58) Field of Classification Search ..... 271/273, 271/274, 277, 182
See application file for complete search history.

(56) References Cited

U.S. PATENT DOCUMENTS

| | | | | |
|---|---|---|---|---|
| 2,869,869 | A | 1/1959 | Bauer | |
| 2,924,453 | A * | 2/1960 | Peyrebrune | 271/182 |
| 2,991,074 | A * | 7/1961 | Saltz et al. | 271/95 |
| 3,002,748 | A * | 10/1961 | Wheeler | 271/114 |
| 3,173,684 | A * | 3/1965 | Binzoni et al. | 271/122 |
| 3,201,115 | A | 8/1965 | Kury | |
| 3,210,073 | A | 10/1965 | Godlewski | |
| 3,506,258 | A | 4/1970 | Lindquist | |
| 3,602,495 | A * | 8/1971 | Hepp | 271/12 |
| 3,741,535 | A | 6/1973 | Palkovic et al. | |
| 4,443,006 | A | 4/1984 | Hasegawa | |
| 4,569,514 | A * | 2/1986 | Holtje | 271/314 |
| 4,825,762 | A | 5/1989 | Fischer | |
| 5,080,341 | A | 1/1992 | Luthy | |
| 5,430,664 | A * | 7/1995 | Cargill et al. | 194/207 |
| 5,615,537 | A | 4/1997 | Vollenweider | |
| 6,224,050 | B1 | 5/2001 | Wicki | |
| 6,394,445 | B1 * | 5/2002 | d'Agrella et al. | 271/182 |
| 6,428,001 | B1 | 8/2002 | Jackson | |
| 6,490,843 | B1 | 12/2002 | May | |

(Continued)

FOREIGN PATENT DOCUMENTS

| | | |
|---|---|---|
| DE | 876848 | 5/1953 |
| EP | 0405107 | 1/1991 |
| EP | 0967164 | 12/1999 |

*Primary Examiner*—Patrick Mackey
*Assistant Examiner*—Thomas A Morrison
(74) *Attorney, Agent, or Firm*—Lucas & Mercanti, LLP

(57) ABSTRACT

An apparatus feeds paper inserts or other flat products from one area to another. The apparatus is particularly useful for newspaper insert machines. A rotating gripper drum or pusher disk feeds paper products from the bottom of a stationary stack down into open moving pockets. Roller assemblies are employed to first speed up the product and then slow the product down as the product exits the feeder. In operation, the product is first quickly accelerated to a speed faster than the circumferential speed of the drum or pusher disk, to maximize feeding speed, and then is quickly decelerated to a slower speed, to prevent the product from bouncing or crumpling in the bottom of the pocket.

5 Claims, 9 Drawing Sheets

U.S. PATENT DOCUMENTS 6,572,097 B2 * 6/2003 d'Agrella et al. ..... 271/182
6,666,447 B2 12/2003 Keller
6,755,412 B1 6/2004 Glowner
7,306,222 B2 12/2007 Kaya et al.
2004/0124579 A1 7/2004 Schafer et al.
2004/0245697 A1 12/2004 Kaya et al.

* cited by examiner

PRODUCT FEEDER WITH ACCELERATOR AND DECELERATOR DEVICES

CROSS REFERENCE TO RELATED APPLICATION

This application is entitled to the benefit of U.S. Provisional Patent Application Ser. No. 60/618,811, filed Oct. 14, 2004. Such application is incorporated herein by reference.

STATEMENT REGARDING FEDERALLY-SPONSORED RESEARCH OR DEVELOPMENT

Not applicable.

BACKGROUND OF THE INVENTION

1. Field of the Invention

This invention relates to an apparatus for feeding flat products such as newspaper inserts, sheets or signatures into pockets or other areas of a machine, and more particularly to an improved feeder having accelerator and decelerator devices to improve feeding speed and efficiency.

2. Description of the Related Art

Typically, in a newspaper insert machine such as one shown in U.S. Pat. No. 4,723,770 or in U.S. Pat. No. 5,823,320, paper inserts or other flat products are placed in a stationary stack, and are fed by an automatic feeder one at a time from the bottom of the stack down into pockets moving beneath the feeder. Such feeders typically employ a rotating drum within the feeder to pull sheets from the bottom of the stack and feed them into the pockets.

There are several challenges that must be overcome in this arrangement to achieve very high speeds together with accurate and efficient paper handling. First, the product must be transferred as quickly as possible from a stationary stack to a moving pocket. When the product is being transferred vertically, the force of gravity is used to assist in product transfer. But gravity is not enough. Just letting the product fall into the pocket does not enable transfer speeds at the desired high rate. An additional mechanical pushing or pulling force is also needed. Next, the product, which in the case of thin, highly flexible paper inserts, must be transferred while keeping the product as straight as possible to maximize transfer speeds while minimizing crumpling or warping. Then, once the product has been transferred to the pocket or other area, it must not be allowed to "crash" into, crumple or jam inside the pocket, or to "bounce" out of the pocket after transfer.

Thus, there is a need for an accelerating device to grab and "shoot" the product down into the pocket or other parts of the machine as fast as possible. At the same time, there is also a need for a decelerating device adjacent to the accelerating device to slow down the product just before the product(s leading edge is about to reach the bottom of the pocket, to prevent the product from bouncing out of the pocket or crumpling within the pocket.

SUMMARY OF THE INVENTION

The present invention satisfies the above-mentioned needs, among others. An improved product feeder is disclosed that automatically feeds flat products at very high speeds to other parts of a machine, such as to open moving pockets in a newspaper insert machine. Feeding speeds of tens of thousands of products per hour are achieved by this invention.

In one embodiment, newspaper inserts are fed one at a time from the bottom of a vertical stack to down near a rotating drum. Various types of drums may be employed. For example, the drum may have grippers that periodically reach out and grab the leading edge of an insert, pull it around the periphery of the drum, and shoot it down into pockets on a moving conveyor. In another embodiment, a segmented pusher disk is used to push the leading edge of an insert down to a pair of rollers.

In both embodiments, the area of feeding and grabbing is important. In the first embodiment, a mechanical gripper grabs the sheets. In the second embodiment, a segmented wheel grabs the sheets. In both embodiments, two roller assemblies are employed. One roller assembly acts as an accelerator device, and the other roller assembly acts as a decelerator device. Specifically, a pair of high-speed nip rollers is mounted adjacent to a pair of lower-speed nip rollers. Each roller in each assembly is arranged to press against an opposite roller, such that each pair of rollers is able to grab and pull a sheet or other flat product passing between the roller pairs. Both roller assemblies are positioned adjacent to a rotating drum or pusher disk of the feeder, near an area where the product is fed from a stack to other parts of a machine. The combination of these roller assemblies first speeds up the motion of the product as it comes off the drum or pusher disk, accelerating it to a linear speed faster than the circumferential speed of the drum or pusher disk, and faster than a speed that would be achieved by free-fall in gravity alone, and then quickly slows the product down before the leading edge of the product hits the bottom of the receiving pocket.

More specifically, in one embodiment, the invention comprises a feeder comprising:

drum means for feeding a flat product from a first area to a second area;

accelerator means adjacent to the drum means to accelerate the product as it comes off the drum means; and decelerator means adjacent to the accelerator means to decelerate the product before the product is fed to a third area.

In another embodiment, the invention comprises an apparatus for feeding flat paper products, comprising:

a feeder having a rotating gripper drum for pulling the leading edge of a flat paper product from the bottom of a stack;

a pair of accelerator rollers biased against each other and adjacent to the drum for accelerating the product as the product comes off the drum; and a pair of decelerator rollers biased against each other, one of which is segmented, adjacent to the accelerator rollers for decelerating the product before the product is released into a pocket.

In another embodiment, the invention comprises an apparatus for feeding flat paper products, comprising:

a feeder having a rotating segmented pusher disk for pushing the leading edge of a flat paper product down from the bottom of a stack;

a pair of accelerator rollers biased against each other, one of which is segmented, adjacent to the pusher disk for accelerating the product away from the pusher disk; and a pair of decelerator rollers biased against each other, one of which is segmented, adjacent to the accelerator rollers for decelerating the product before the product is released into a pocket.

In another embodiment, the invention comprises an accelerator/decelerator apparatus, comprising:

a pair of accelerator rollers biased against each other, for accelerating a flat product from one area to a second area, and a pair of decelerator rollers biased against each other, one of which is segmented, adjacent to the accelerator rollers for decelerating the product before the product is transported to a third area.

BRIEF DESCRIPTION OF THE DRAWINGS

These and other aspects of the present invention may be more fully understood by reference to one or more of the following drawings, in which.

DETAILED DESCRIPTION OF THE INVENTION

The following is a description of some embodiments of the present invention that are particularly useful for feeding flat paper, plastic or other products, such as inserts, sheets, cards, signatures, disks, mail, film packages, etc., from a stationary location to a moving location. In one embodiment, the product is grabbed from a stationary stack, pulled around the periphery of a rotating drum within a product feeder, and is then subsequently delivered at high speed to a moving, vertically-oriented pocket open at the top and being carried by a linear conveyor moving beneath the product feeder. The invention is not, however, limited to such uses and is usable in any environment where feeding of a flat product is needed to transfer the product from one location in a machine to another efficiently and at very high speed.

Figure 1:
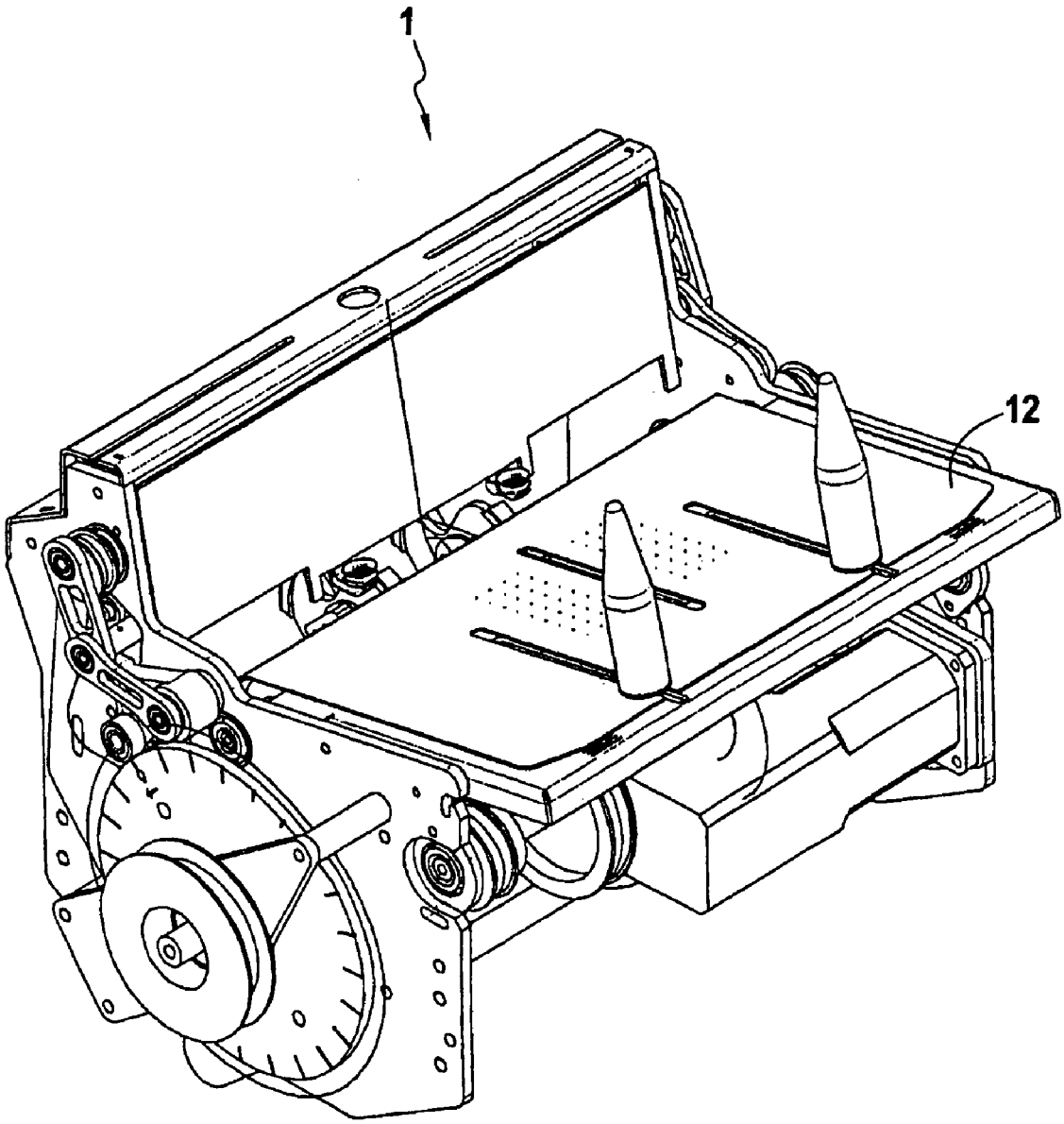
FIG. 1 is a perspective view of one embodiment of the invention.
Figure 2:
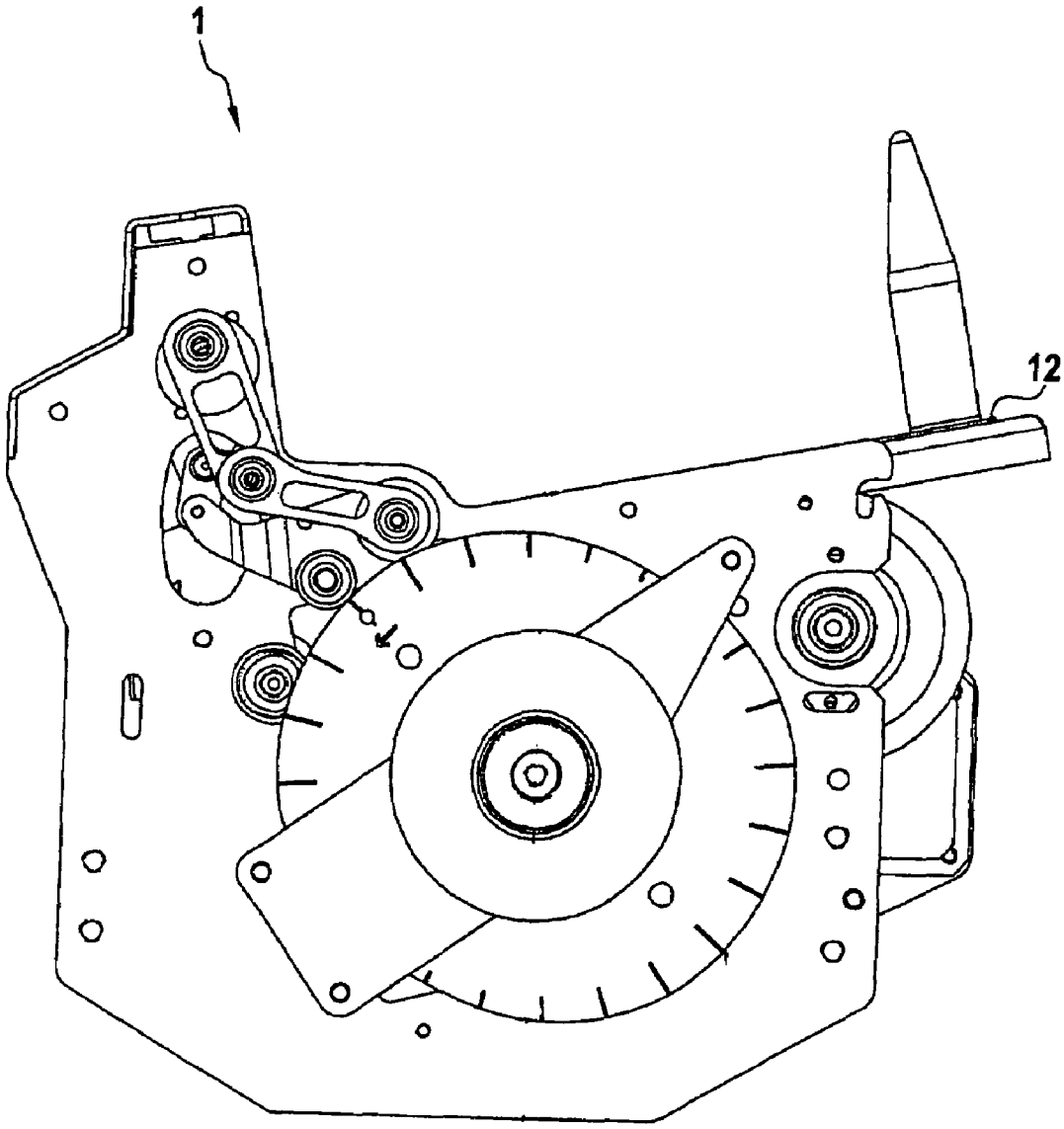
FIG. 2 is a side view of the embodiment of FIG. 1.
Figure 3:
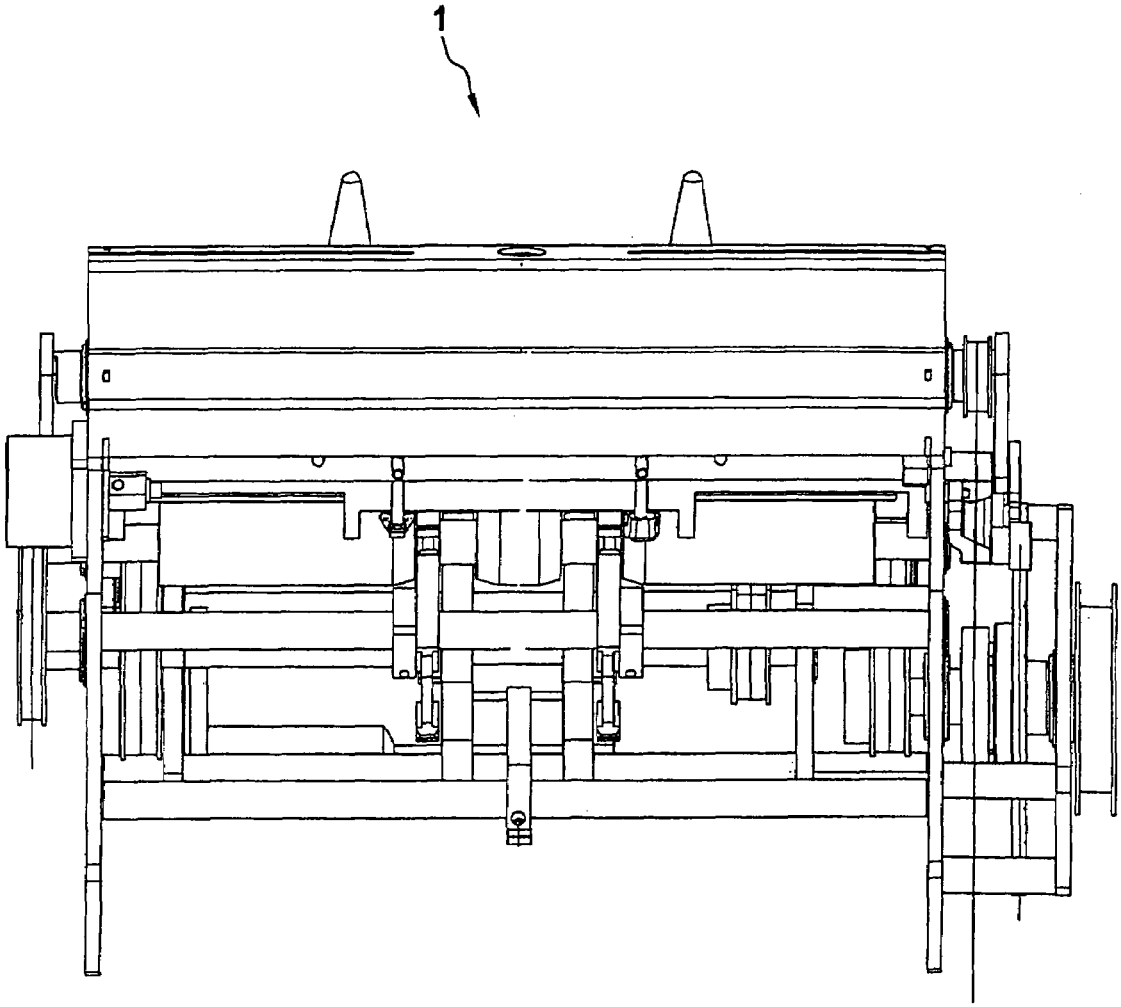
FIG. 3 is a rear view of the embodiment of FIG. 1.
Figure 4:
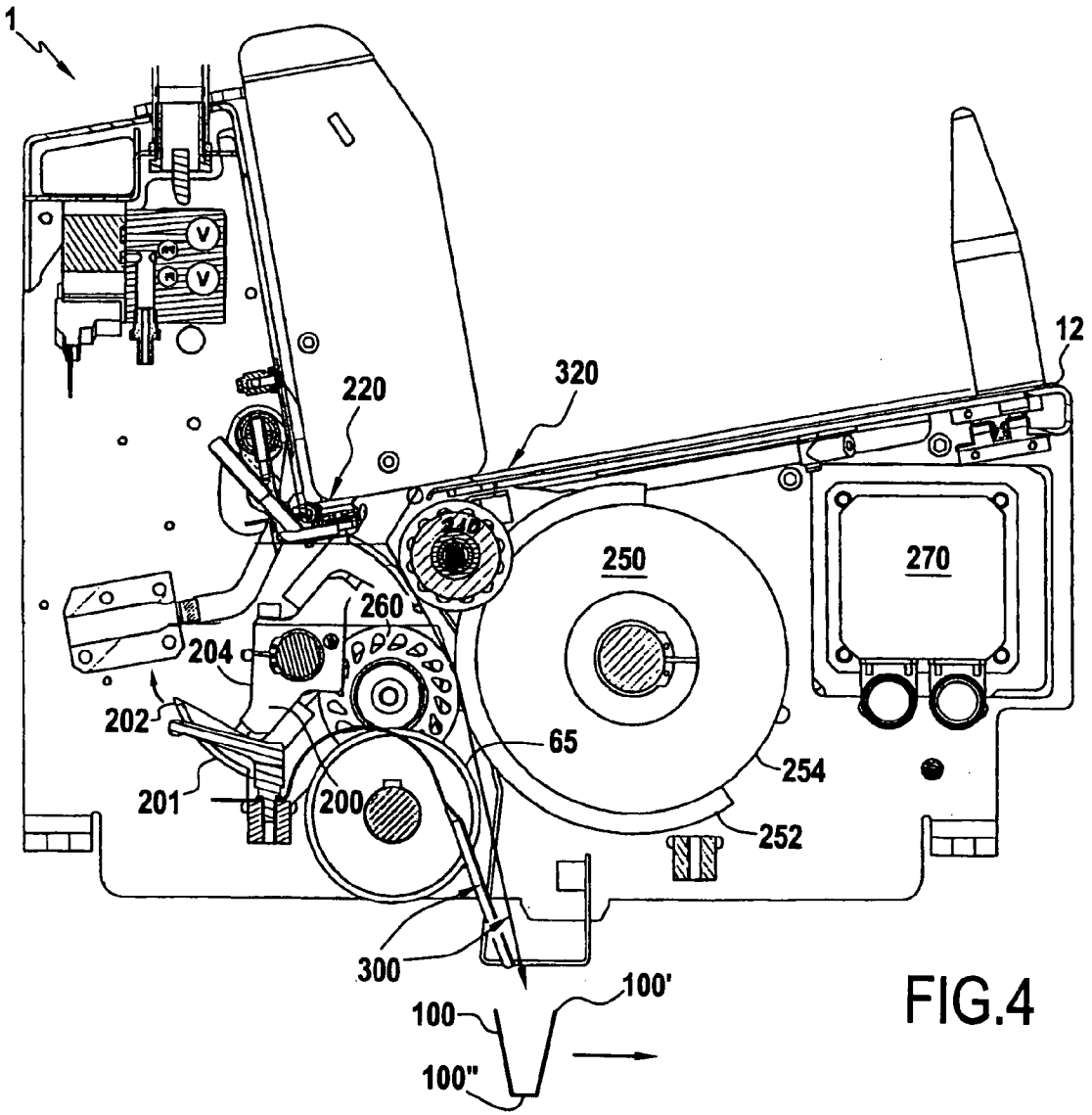
FIG. 4 is a side cutaway view of the embodiment of FIG. 1.

The exterior appearance of one embodiment of the invention is shown in FIGS. 1-3, and the major internal moving parts are shown in FIG. 4. These figures are discussed in more detail below.

Figure 5:
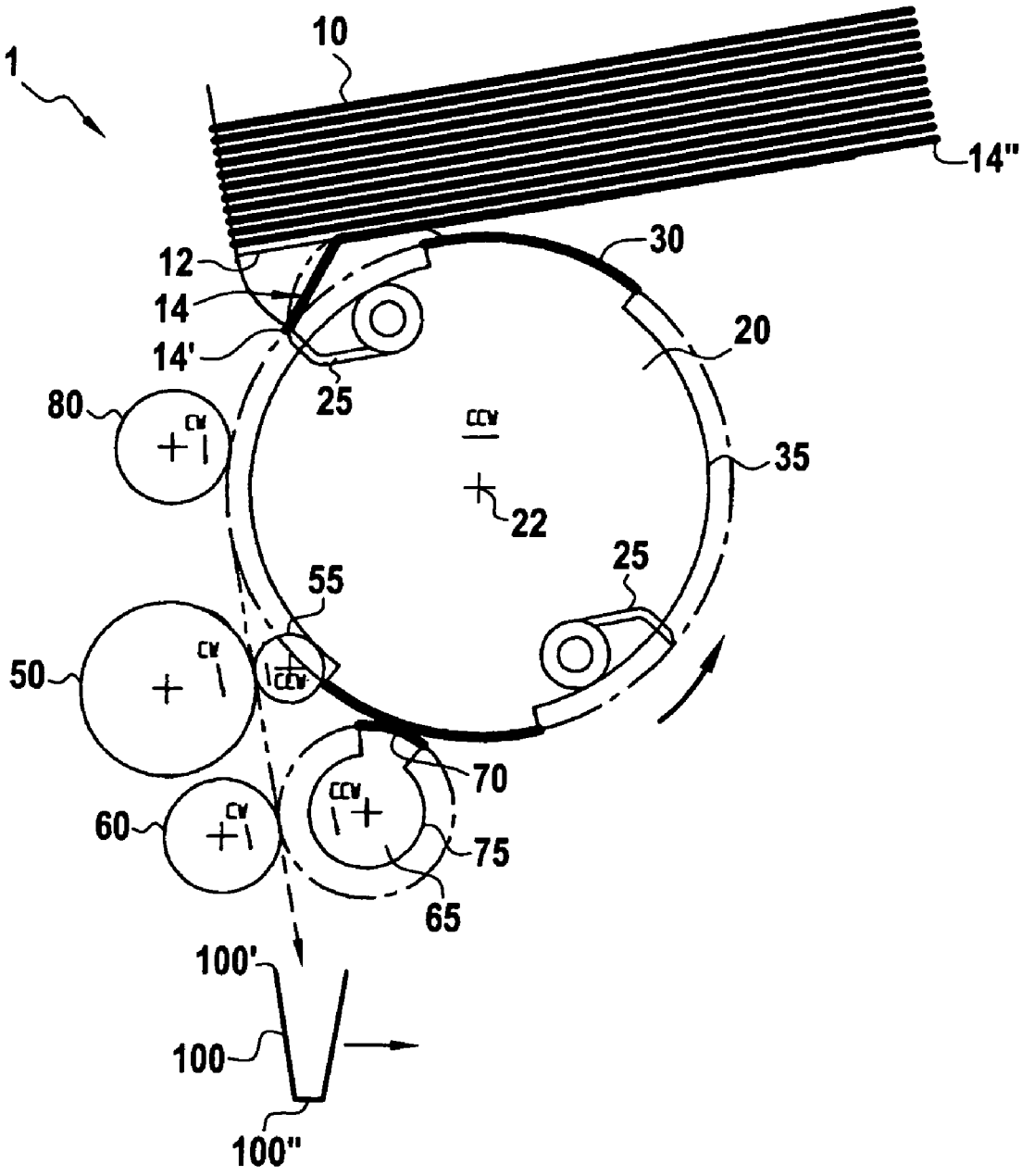
FIG. 5 is a side cutaway view of another embodiment of the invention.

Another embodiment of the invention is shown in FIG. 5. Product feeder 1 comprises a motor-driven unit for feeding flat products such as paper inserts one at a time from the bottom of a stack 10 down into open moving pockets 100. The stack of products is held on a tray 12. In a preferred embodiment, feeder 1 is mounted above a horizontal, linear, moving conveyor (not shown) carrying vertically-oriented pockets 100. Each pocket has an open top 100' and a closed bottom 100".

Within the feeder 1 is a rotating gripper drum 20 having a shaft 22 driven by an electric motor (not shown). In the embodiment illustrated in FIG. 5, the drum 20 rotates counterclockwise. The rotational speed is preferably constant, but may be varied if desired. Drum 20 has one or more grippers 25 arranged around the periphery of the drum. As the drum rotates, each gripper is configured to periodically reach out (away from the drum) quickly, rotate quickly in a direction opposite to the direction of rotation of the drum, and then rotate downwards (toward the drum) quickly to grab and pull the leading edge of a product around the drum at appropriate times in the drum(s rotational cycle. The gripper then rotates forward and back into the drum quickly to release the product into the pocket at the appropriate time. A typical sequence of operations is described below.

Drum 20 also has areas of varying friction around its periphery. In this embodiment, as shown in FIG. 5, drum 20 has one or more areas of high-friction surface material 30 such as rubber interposed between one or more areas of low-friction surface material 35. The areas of low-friction surface are also slightly recessed under the outer rim of the drum 20.

In a feature of the invention, two assemblies of rotating rollers are mounted near the drum 20. The first assembly comprises one or more accelerator rollers 50 mounted opposite to one or more accelerator backup rollers 55. Rollers 50 and 55 are arranged to press against each other tightly, with a biasing device such as a spring (not shown), and are configured such that a paper insert or other flat product may pass between, and be tightly grabbed and pulled by, the rollers. Thus, the two rollers 50, 55 form a nip, and are sometimes referred to herein as high-speed nip rollers. Roller 50 is motor-driven, but roller 55 is not. However, both rollers may be driven if desired.

In another feature of the invention, both high speed nip rollers 50, 55 are mounted adjacent to, but do not rotate synchronously with, the rotating drum 20. Instead, they rotate faster. The purpose of the faster rotation is to pull the product away from the drum faster than the circumference of the drum is rotating. That way, the product will be shot down faster into the pocket than the drum could otherwise push it or drop it. The axis of rotation of each roller 50, 55, is parallel to the shaft 22 (axis of rotation) of the drum 20. It can, however, be seen in FIG. 5 that roller 55 is not always in contact with the high-friction surface 30, because the surface of drum 20 is segmented. The purpose of the segmented structure is to first allow the insert 14 to be gripped tightly around the drum 20, then to allow the insert to be released quickly for feeding down into the pocket 100.

One or more carry-down rollers 80 are also provided above the high-speed nip rollers 50, 55. Preferably, rollers 80 have a high-friction surface, and are biased against the periphery of the drum, to form a nip that assists in pulling inserts 14 around the periphery of the drum 20. In this embodiment, rollers 80 are idler rollers, i.e., not actively driven by a motor. They may, however, be driven if desired.

Mounted adjacent to, and preferably below, the high-speed nip rollers 50, 55 are one or more smooth decelerator rollers 60, as shown in FIG. 5. Each roller is driven and preferably has a smooth, high-friction material around its periphery. Adjacent to roller 60 is a driven, segmented decelerator roller 65. Rollers 60 and 65 are configured such that a paper insert or other flat product may pass between the rollers.

Roller 65 is segmented. A high-friction surface material 70 covers a small portion of the periphery of roller 65, and a low-friction surface material 75 covers the remainder of its periphery. The arcuate segment of low-friction surface material 75 is radially inward of the arcuate segment of high-friction surface material 70 as shown in FIG. 5. When the high-friction surface material 70 is directly opposite roller 60, a nip is formed. Rollers 60 and 65 are sometimes referred to herein as low-speed nip rollers.

Figure 6:
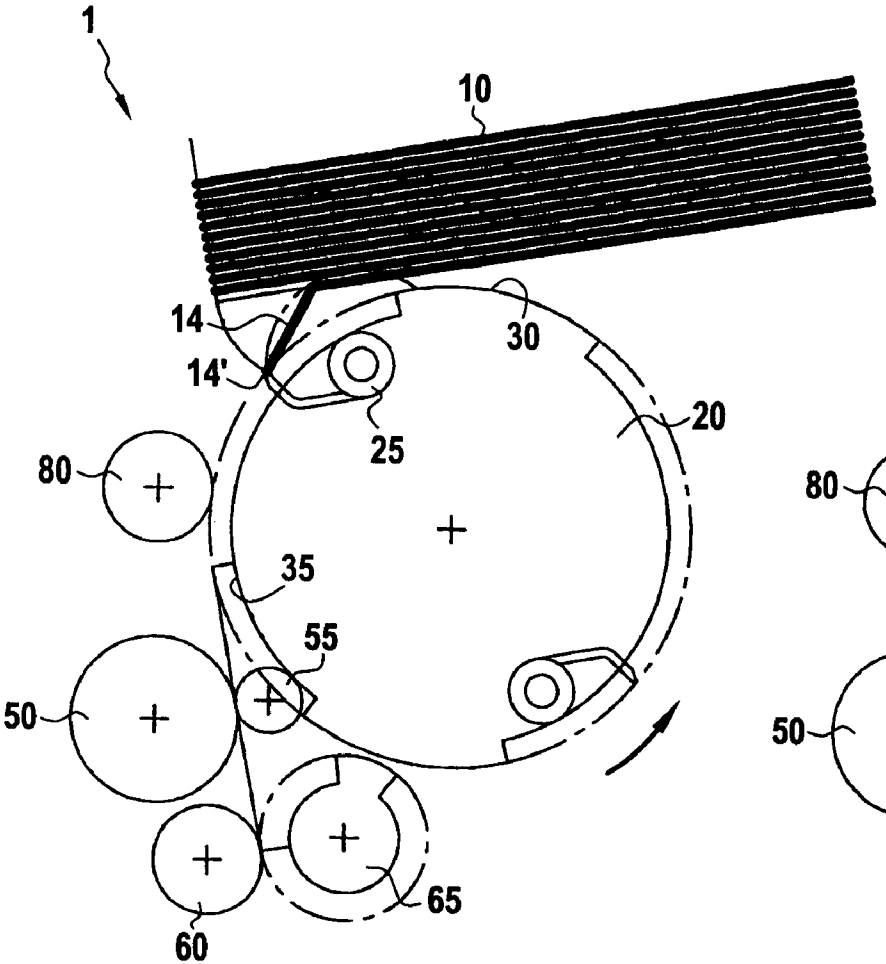

The operation of the embodiment of FIG. 5 will now be described, with reference to FIGS. 6-11. In FIG. 6, it can be seen that a leading edge 14' of the lower-most insert 14 has been pulled down from the other inserts above it in the stack. In a preferred embodiment, this is accomplished by way of a reciprocating sucker device (not shown) that pulls the edge of the insert down by vacuum. A pusher device (not shown) may also be employed instead of or in addition to the sucker device to push the leading edge of the insert down further. At this point, as shown in FIG. 6, the leading edge 14' of the insert is resting against the periphery of the drum 20. Gripper 25 is in its retracted position within the drum.

Figure 7:
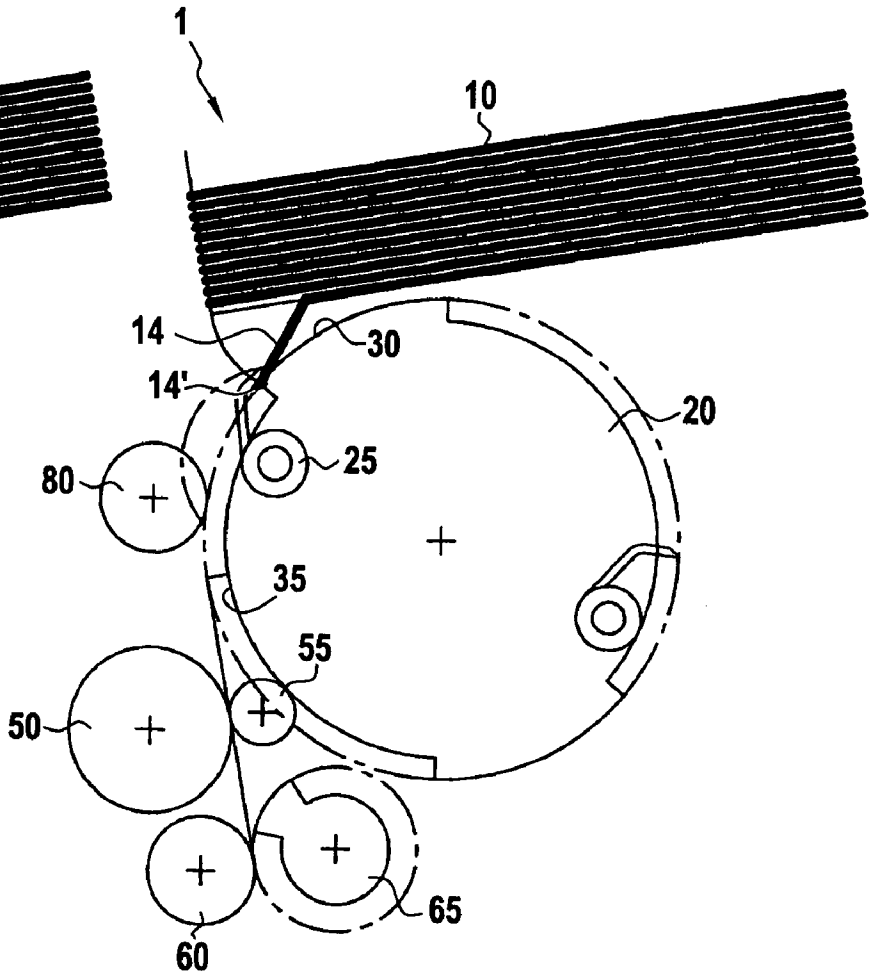
FIGS. 6-11 are side cutaway views, in progressive time sequence, showing the progress of a product through the apparatus of FIG. 5.

Looking now at FIG. 7, drum 20 has rotated approximately 30-40 degrees counterclockwise, and gripper 25 has extended out from the drum, rotated clockwise, and has grabbed the leading edge 14' of the insert 14.

Figure 8:
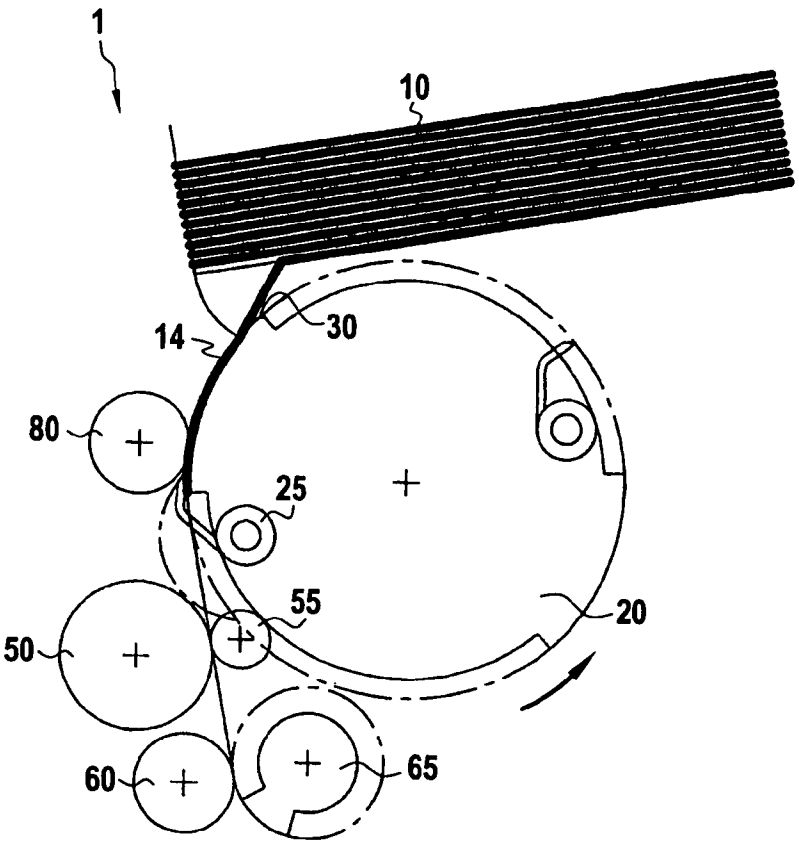

In FIG. 8, as the drum 20 continues to rotate, insert 14 is shown being pulled counterclockwise around the high-friction surface 30 of the drum by the gripper 25 and the carry-down rollers 80.

Figure 9:
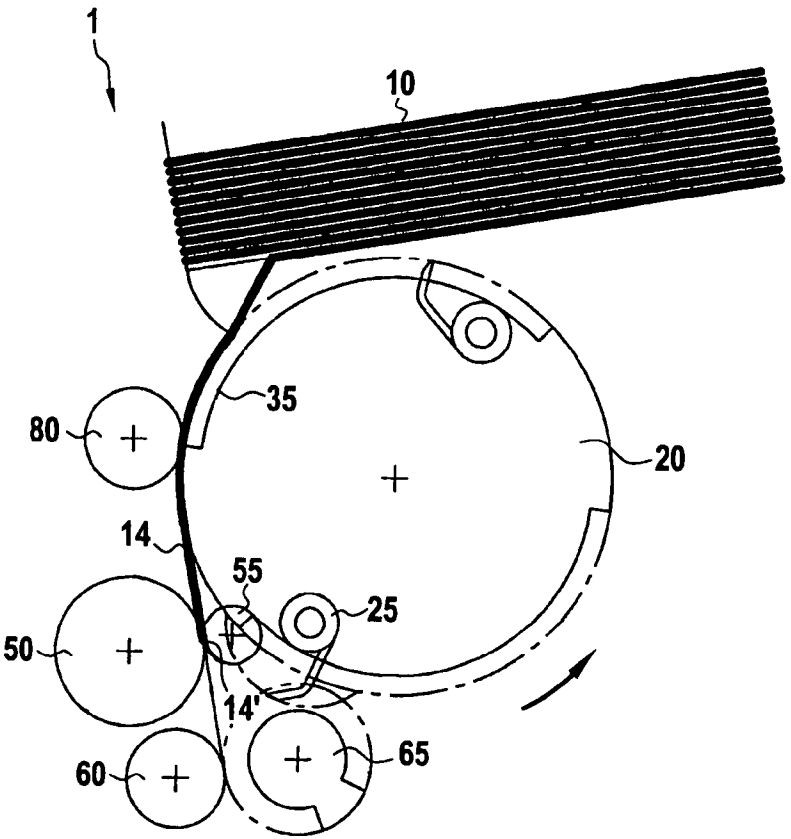

In FIG. 9, as the drum 20 continues to rotate, the gripper 25 has released the leading edge 14' of the insert 14, thus allowing the leading edge to move away slightly from the drum. Immediately after release, the leading edge is grabbed between the high-speed nip rollers 50, 55. In a feature of the invention, since the peripheries of rollers 50, 55 are rotating faster than the periphery of the drum, insert 14 is immediately accelerated. This enables higher-speed feeding than would otherwise be possible. Insert 14 is able to easily slide around the periphery of the drum because, at this point, the majority of the lower surface of the insert is resting against, or slightly above, the low-friction surface area 35 of the drum.

Figure 10:
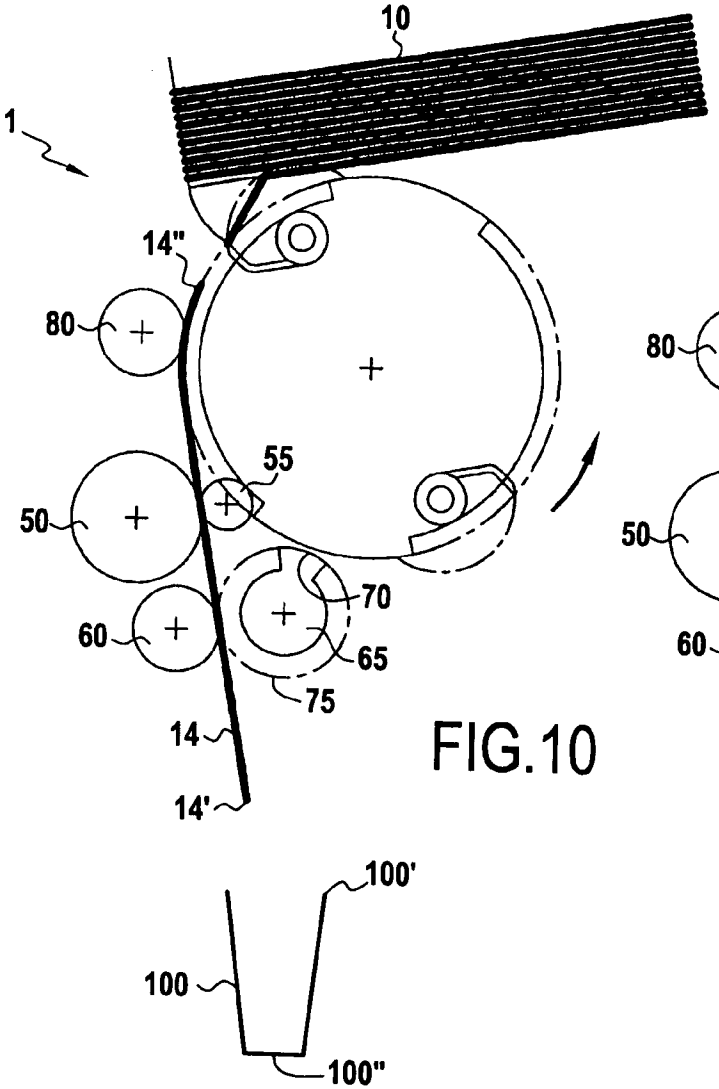

In FIG. 10, as the drum continues to rotate, insert 14 has now started to pass between the low-speed nip rollers 60, 65. At this point, since the surface of the insert is resting against or just above the low-friction surface 75 of segmented roller 65, the insert is actually sliding across, rather than being pulled by, rollers 60, 65.

Figure 11:
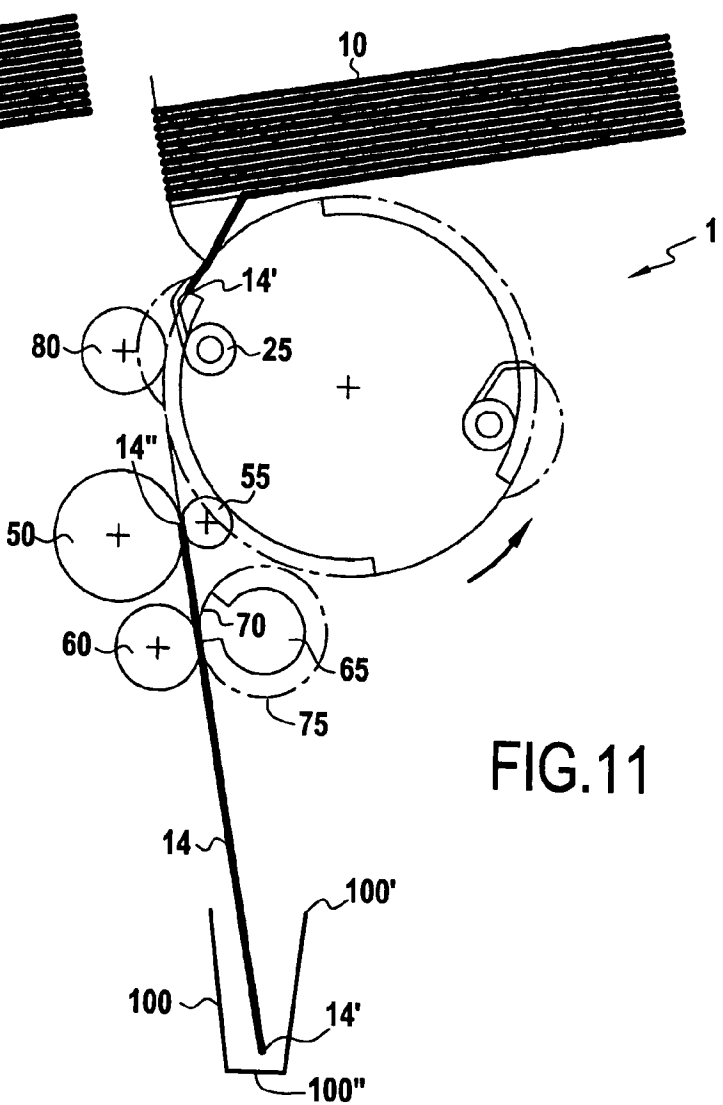

In FIG. 11, the trailing edge 14" of the insert 14 is shown being released from the high-speed nip rollers 50, 55, and then being immediately grabbed by the high-friction surface segment 70 of the low-speed nip rollers 60, 65. Since the peripheries of rollers 60, 65 are moving slower than the insert, insert 14 is immediately decelerated so that it may be properly fed into pocket 100. The purpose of the segment is for accurate timing of the deceleration. Specifically, deceleration is delayed until the last possible moment, so as to maintain maximum feeding speed consistent with proper paper handling. In this way, the insert 14 drops into the pocket 100 without crumpling or bouncing, yet at high speed. At approximately the same time, or slightly before, the leading edge 14' of the next insert in the stack is being grabbed by another gripper 25 to begin the next feeding cycle.

Figure 12:
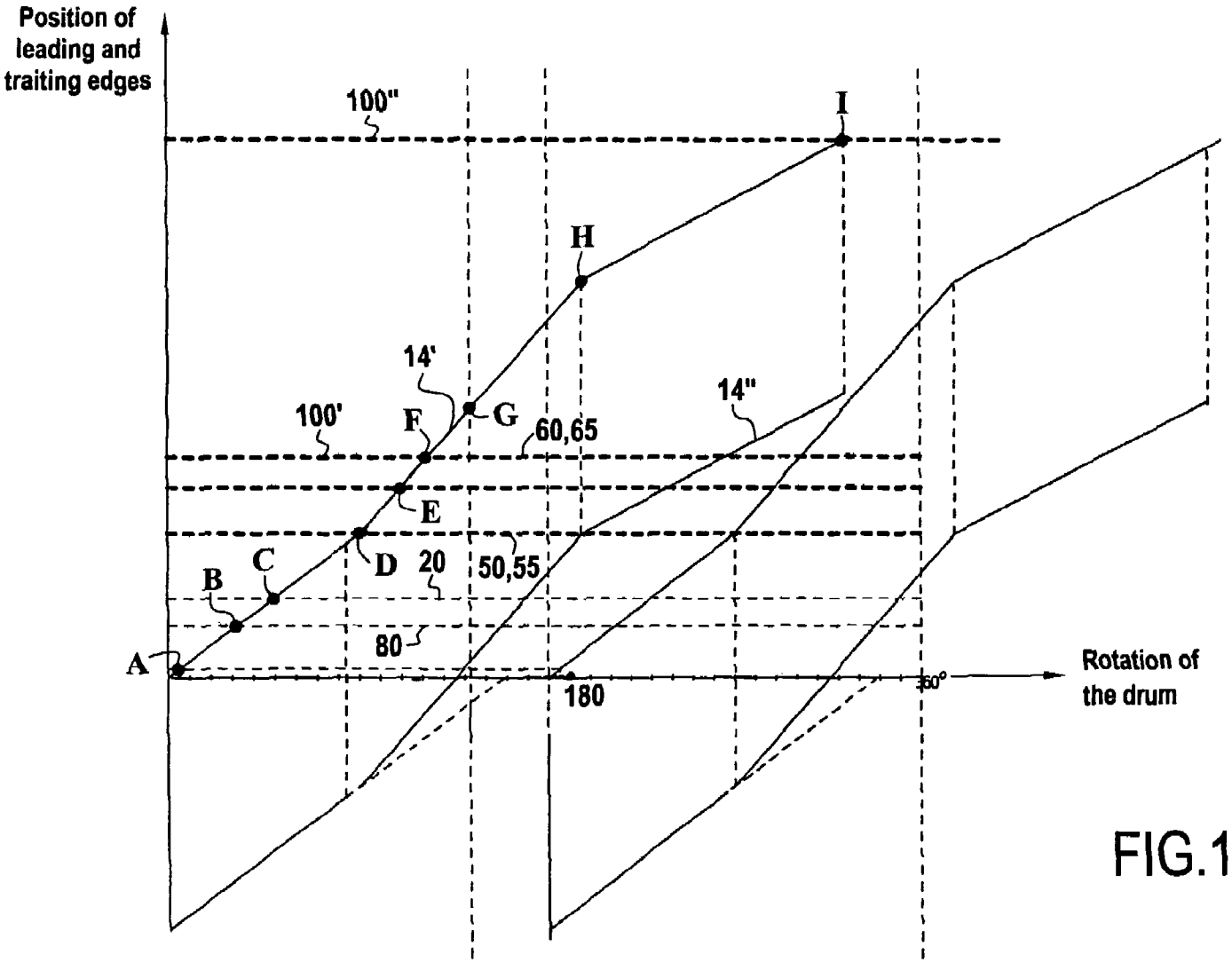
FIG. 12 is a graph showing the position and speed of leading and trailing edges of an insert as it travels through the apparatus of FIG. 5 during one rotation of the drum.

The timing of the operations described in FIGS. 4-11 is shown in more detail in FIG. 12, which is a graph showing the position and speed of the leading edge 14' and trailing edge 14" of an insert as it travels through the apparatus during one rotation of the drum. The horizontal axis shows the position of a point on the periphery of the drum. The vertical axis shows the position of the leading and trailing edges of the insert as the drum makes one full 360-degree rotation. At the point labeled "A" in FIG. 12, gripper 25 has grabbed the leading edge 14' of insert 14, as shown in FIG. 7. At point B, the leading edge has reached the upper carry-down rollers 80, as shown in FIG. 8. At point C, the leading edge has left the periphery of the drum. At point D, the leading edge has reached, and is grabbed by, the high-speed nip rollers 50, 55, as shown in FIG. 9. It will be noticed that the slope of the graph line representing the leading edge becomes steeper at this point, indicating that the speed of travel of the insert 14 has been accelerated. At point E, the leading edge has started to pass between, but is not yet grabbed by, the low-speed nip rollers 60, 65, as shown in FIG. 10. At point F, the leading edge has reached the top 100' of pocket 100. At point G, the gripper 25 has been fully retracted back into the drum. At point H, the leading edge has reached, and is grabbed by, the high-friction surface area 70 of the segmented decelerator roller(s) 65, as shown in FIG. 11. This action causes the insert 14 to immediately decelerate, as illustrated in the graph of FIG. 12, by the flattening of the slope of the line representing the travel path of the leading edge. Finally, at point I, the leading edge of the insert has reached the bottom 100" of pocket 100, thus completing a feeding cycle for one insert.

In a feature of the invention, the feeding of the next insert in the stack 10 is started before the first insert has been completely fed into a pocket. As seen in FIG. 12, this occurs at a time slightly before the time point H has been reached by the leading edge of the first insert. This enables higher-speed operation than would otherwise be achieved.

Another embodiment of the present invention is illustrated in FIGS. 1-4. In this embodiment, a product feeder 1 is shown for feeding inserts or other flat products from a tray 12 down to pockets 100 having an open top and moving in a straight line underneath the feeder. Unlike the embodiment of FIG. 5, this embodiment does not employ a rotating gripper drum to pull products down through the feeder. Instead, inserts are fed from a tray 12 down into the pockets by a special internal arrangement of moving suckers, disks and rollers, as shown in FIG. 4.

In this arrangement, one or more reciprocating suckers 220 are mounted underneath tray 12. These are configured to periodically pull down, using vacuum, the leading edges of inserts or other products stacked in the tray. A pusher blade or other device (not shown) may also be employed in addition to or instead of the suckers, to push the leading edge of the product downward. In addition, pulses of air are periodically blown from a nozzle 320 between the lowermost sheet and the second lowermost sheet in the tray to separate the sheets. Air is pulsed in timed relationship with the movement of the suckers 220.

In a feature of the invention, as shown in FIG. 4, one or more segmented pusher disks 200 are mounted adjacent to, and preferably underneath, the suckers 220. Disk 200 preferably has two or more protruding portions 202, followed by one or more depressions 204, arranged around its periphery. In the preferred embodiment, two protruding portions and two depressions are used. Each protruding portion has a high-friction surface 201. The disk is driven by a servo motor 270. In the embodiment shown in FIG. 4, the disk rotates clockwise.

Biased against the protruding portions of disk 200 is a pusher disk backup roller 210. This may either be an idler roller or it may be driven. Preferably, roller 210 is made of urethane or other compliant material. A pinch point is created between the surface 201 of disk 200 and roller 210. As the lowermost sheet enters this pinch point, the sheet is pulled rapidly downward away from the tray.

In another feature of the invention, mounted adjacent to the pusher disk 200 is a segmented speedup roller 250 driven by motor 270. Roller 250 has a high-friction surface 252 around most of its periphery, and a low-friction surface 254 around a small portion of its periphery. Surface 254 is preferably recessed slightly within roller 250. Biased against roller 250 is a speedup roller backup roller 260, which is preferably an idler roller. Rollers 250 and 260 are configured such that a paper insert or other flat product may pass between the rollers.

Mounted adjacent to, and preferably below, rollers 250 and 260 are one or more smooth decelerator rollers 65, as shown in FIG. 4. Each roller is driven and preferably has a smooth, high-friction material around its periphery. Adjacent to roller 60 is a driven, segmented decelerator roller 65. Rollers 65 are configured such that a paper insert or other flat product may pass between the rollers. Roller 65 may be segmented. A high-friction material may cover at least a portion of the periphery of roller 65, and a low-friction material may cover another portion of its periphery.

In another feature of the invention, one or more sheet steel guides 300 are mounted adjacent to roller 65 and extend part way below it. These guides serve to stiffen the product as it is fed down into the pocket, so as to minimize the tendency of the product to crumple as it hits the bottom of the pocket at high speed. The guides also help to slow down the product by friction.

In operation, after a sucker 220 has pulled down the leading edge of the lower-most insert in the tray 12, and as the segmented pusher disk 200 rotates clockwise, a protruding portion 202 of the disk engages the upper surface of the leading edge and begins to push it downward. As the disk 200 continues to rotate, the insert is caught temporarily in a depression 204 in the disk, and the insert is bent further downward until if reaches the backup roller 210. At this point, the insert is grabbed by the nip formed by the disk-roller pair. The frictional contact pulls the insert further down from the stack When the leading edge of the insert reaches segmented speedup roller 250, it is grabbed by the nip formed by the pair of rollers 250, 260 when their high-friction surfaces are in contact. The insert is then accelerated downward. The purpose of the low-friction segment of 250 is to allow the roller to slide past the insert as the insert is first being fed down from the pusher disk 200. This prevents tearing of the insert since the peripheral speed of the pusher disk 200 is lower than the peripheral speed of the speedup roller 250.

The insert needs to be slowed down before it is released into a pocket 100. Since the periphery of roller 65 is moving slower than the insert, insert 14 is immediately decelerated as the leading edge of the insert reaches the nip formed by roller 60 pressing against the high-friction surface segment 70 of roller 65. The purpose of the segment is for accurate timing of the deceleration. Specifically, deceleration is delayed until the last possible moment, so as to maintain maximum feeding speed consistent with proper paper handling. In this way, the insert 14 drops into the pocket 100 without crumpling or bouncing, yet at high speed.

A more detailed, step-by-step description of the operation of a preferred embodiment of the invention of FIG. 4 is as follows. First, a stack of products is placed in the feed tray. Each product is typically a flat, folded paper sheet, with the folded edge resting toward the left side of FIG. 4.

Next, the product stack is "jogged" by a vibrating panel to ensure the folded edges are uniform and in the same plane. Air is also introduced by the panel to inflate and separate the product.

Next, an array of reciprocating suction cups (such as 5 cups moving together) bends the "nose" of the lowermost product down. The suction cups do not move the product's surface that is in contact with the feed tray.

Next, separator fingers rotate to create a pinch point between the urethane surface of the separator finger and the opposing compliant rollers. This captures the full product thickness and creates linear motion in the product relative to the feed tray.

Next, while the product is being removed from under the pile, a blast of air separates the moving product from the stationary product immediately above. Preferably, air only pulses when the product is experiencing linear motion.

Next, a pinch point or nip is created between a high speed wheel 250 and a compliant backup wheel 260. This set of wheels doubles the product speed. The large diameter wheel 250 has a step in the outer diameter to allow the product to be engaged by the full product thickness.

Next, rollers 65, which preferably are of fixed diameter, rotate at one-half the linear speed of the rollers in the prior high speed section. The urethane surface of the wheel slows the product down for proper exit from the feeder.

Next, sheet steel guides 300 form the product for stiffness upon exiting the feeder and continue to decelerate the product due to friction of the paper sliding along the surface of the guides.

Finally, the product completely exits from the bottom of the feeder and is inserted into a moving pocket 100.

Although only a few embodiments of the present invention have been expressly disclosed, the invention is, nonetheless, to be broadly construed, and is not to be limited except by the character of the claims appended hereto.

What is claimed is:

1. An apparatus for feeding flat paper products, comprising:

a feeder having a rotating gripper drum for pulling the leading edge of a flat paper product from the bottom of a stack;

a pair of accelerator rollers contacting each other and adjacent to the drum for accelerating the product as the product comes off the drum; and a pair of decelerator rollers contacting each other, one of which is segmented and which presents a periphery which contacts the other decelerator roller, a high-friction material presenting a high friction surface covering a portion of the periphery of the segmented roller and a low friction material presenting a low friction surface covering a remaining portion of the periphery of the segmented roller, each of which portions defines an arcuate segment of the periphery of the segmented roller, the arcuate segment of the low-friction surface being radially inward of the arcuate segment of the high-friction surface, the decelerator rollers adjacent to the accelerator rollers for decelerating the product before the product is released into a third area wherein the surface of the high friction material provides more frictional resistance to sliding of flat paper products than the surface of the low friction material.

2. An apparatus for feeding flat paper products, comprising:

a feeder having a rotating segmented pusher disk for pushing the leading edge of a flat paper product down from the bottom of a stack;

a pair of accelerator rollers contacting each other, one which is segmented, adjacent to the pusher disk for accelerating the product away from the pusher disk; and a pair of decelerator rollers contacting each other, one of which is segmented and which presents a periphery, a high-friction material presenting a high friction surface covering a portion of the periphery of the segmented roller and a low friction material presenting a low friction surface covering a remaining portion of the periphery of the segmented roller, each of which portions defines an arcuate segment of the periphery of the segmented roller, the arcuate segment of the low-friction surface being radially inward of the arcuate segment of the high-friction surface, the decelerator rollers adjacent to the accelerator rollers for decelerating the product before the product is released into a third area, wherein the surface of the high friction material provides more frictional resistance to sliding of flat paper products than is the surface of the low friction material.

3. An accelerator/decelerator apparatus, comprising:

a pair of accelerator rollers contacting each other, for accelerating a flat product from one area to a second area; and a pair of decelerator rollers contacting each other, one of which is segmented and which presents a periphery, a high-friction material presenting a high friction surface covering a portion of the periphery of the segmented roller and a low friction material presenting a low friction surface covering a remaining portion of the periphery of the segmented roller, each of which portions defines an arcuate segment of the periphery of the segmented roller, the arcuate segment of the low-friction surface being radially inward of the arcuate segment of the high-friction surface, the decelerator rollers adjacent to the accelerator rollers for decelerating the product before the product is transported to a third area, wherein the surface of the high friction material provides more frictional resistance to sliding of flat products than is the surface of the low friction material.

4. An apparatus as set forth in claim 1, wherein the third area is beneath the feeder.

5. An apparatus for feeding flat paper products, comprising:

a feeder having a rotating gripper drum for pulling the leading edge of a flat paper product from the bottom of a stack;

a pair of accelerator rollers contacting each other, adjacent to the gripper drum for accelerating the product as the product comes off the drum; and a pair of decelerator rollers contacting each other, one of which is segmented and has a periphery that is partially covered with a high-friction material presenting a high friction surface and a low friction material covering a remaining portion of the periphery of the segmented roller, wherein the decelerator rollers decelerate the product before the product is released into a third area that is beneath the decelerator rollers, and wherein the surface of the high friction material provides more frictional resistance to sliding of flat paper products than the surface of the low friction material.

* * * * *